United States Patent [19]

Kotabe et al.

[11] 4,107,535

[45] Aug. 15, 1978

[54] X-RAY APPARATUS UTILIZING ROTARY ANODE TYPE X-RAY TUBES

[75] Inventors: Munenori Kotabe, Mobara; Yasuji Nomura, Matsudo, both of Japan

[73] Assignee: Hitachi, Ltd., Tokyo, Japan

[21] Appl. No.: 696,753

[22] Filed: Jun. 16, 1976

[30] Foreign Application Priority Data

Jun. 20, 1975 [JP] Japan ..... 50-74474

[51] Int. Cl.[2] ..... H05G 1/70

[52] U.S. Cl. ..... 250/406

[58] Field of Search ..... 250/402, 406, 421

[56] References Cited

U.S. PATENT DOCUMENTS

| | | | |
|---|---|---|---|
| 2,215,399 | 9/1940 | Kloos | 250/406 |
| 3,335,280 | 8/1967 | Wright | 250/406 |

*Primary Examiner*—Bruce C. Anderson

*Attorney, Agent, or Firm*—Charles E. Pfund

[57] ABSTRACT

In X-ray apparatus utilizing a rotary anode type X-ray tube in which a rotary anode provided with a target is rotated by a rotor driven by a stator on the outside of the tube, the stator windings are energized by a single phase or three phase alternating current source and high positive potential is applied to the anode electrode and one of the stator windings so as to eliminate an insulator between the anode electrode and the stator.

5 Claims, 9 Drawing Figures

X-RAY APPARATUS UTILIZING ROTARY ANODE TYPE X-RAY TUBES

BACKGROUND OF THE INVENTION

This invention relates to an X-ray apparatus utilizing a rotary anode type X-ray tube, more particularly a rotary anode type X-ray tube using high acceleration voltage.

Radiography is now widely used to examine metal structure, casting, or a product. In order to obtain a clear radiograph of a nuclear fuel rod comprising a casing and a fissionable material contained therein, it is necessary to use hard X-rays having a high transmittivity for such substance. Such hard X-rays can be produced by impressing a high acceleration voltage across an anode electrode that is a target generating X-rays and a cathode electrode that emits an electron beam. Although a stationary anode type X-ray tube can operate under a considerably high acceleration voltage, in the case of a rotary anode type X-ray tube, about 150 KV is the upper limit of the acceleration voltage from the standpoint of electrical insulation.

Where a nuclear fuel rod is examined by X-rays, radiations from the fissionable substance, uranium for example, are sensed by X-ray films so that if the exposure is made for a long time, the background density of the exposed X-ray film would increase, thus erasing an image necessary for the inspection. For this reason, a short time exposure is essential. To obtain a radiograph of the desired contrast by a short time exposure, it is necessary to generate a large amount of X-rays per unit time and hence to greatly increase the tube current. In the case of the stationary anode type X-ray tube in which a definite point or small area on the target is subjected to the bombardment of the electron beam, the anode electrode can not withstand large tube current thus damaged. On the other hand, the rotary anode type X-ray tube in which the impinging point on the targent moves constantly can withstand such large current. For example, comparing the inputs (acceleration voltage X tube current) of a conventional rotary anode type X-ray tube and a stationary anode type X-ray tube, the input of the latter is at most 4KW while the former can produce an input up to 100KW. Assume now that both types utilize the same acceleration voltage for producing X-rays of the same hardness, the rotary anode type X-ray tube can produce tube current 25 times that of the stationary anode type X-ray tube thereby greatly increasing the quantity of X-rays generated per unit time.

In this manner, although the rotary anode type X-ray tube is suitable to operate delivering a high output, there is a limit for the acceleration voltage in view of the problem of electrical insulation as above described.

More particularly, since the prior art rotary anode type X-ray tube has been energized by a high voltage circuit with its neutral point grounded, a positive high potential is impressed upon the anode electrode whereas a small potential difference at low level voltage is impressed across a stator disposed about a rotor for driving the anode electrode. For this reason, the insulation between the anode electrode and the stator should be high and poor insulation renders inoperative the X-ray apparatus utilizing the X-ray tube. A cylindrical insulator generally made of a plastic or glass is used as the insulator between the anode electrode and the stator. When operated under anode potential, such insulator is liable to breakdown. Such difficulty can be avoided by increasing the gap between the anode electrode and the stator as by using a thicker insulating cylinder. Increased gap renders it difficult to transmit magnetic flux from the stator to the rotor thus decreasing the efficiency of the motor with the result that the number of revolutions of the anode electrode is decreased or the starting time of the anode electrode is increased. Increase in the width of the gap also increases the size of the X-ray tube unit.

SUMMARY OF THE INVENTION

Accordingly, it is an object of this invention to provide an improved rotary anode type X-ray tube capable of producing high tube current under high acceleration voltage.

Another object of this invention is to provide a novel rotary anode type X-ray tube which does not require to use an insulator between the rotor and stator, thus increasing the efficiency of the driving motor.

According to this invention, these and further objects can be accomplished by providing an X-ray apparatus comprising an X-ray tube unit and driving source means therefor, wherein the X-ray tube unit includes a rotary anode type X-ray tube with an anode electrode having a target adapted to generate X-rays and a rotor for rotating the anode electrode and the target, the anode electrode being rotably supported in an envelope, and with a cathode electrode having at least one filament which is disposed in the envelope to oppose the target, and includes a stator positioned on the outside of the envelope and provided with stator windings for generating a magnetic field for rotating the rotor; and the driving source means includes means for impressing a potential difference across the filament, means for impressing a predetermined negative high potential upon the cathode electrode, means for impressing a predetermined positive high potential upon the anode electrode, and means for impressing a low motive power potential difference at high potential across the terminals of the stator windings, characterized in that the means for impressing the voltage upon the terminals of the stator windings includes a high voltage insulation transformer having a primary winding and a secondary winding which are insulated from each other, that the primary winding is connected to a source of alternating current, that the secondary winding is connected to the stator windings, and that either one of the stator windings is connected to receive the positive high potential.

The positive high potential can be connected to the stator winding interiorly or exteriorly of the X-ray tube unit.

DESCRIPTION OF THE PREFERRED EMBODIMENTS

Figure 1A:
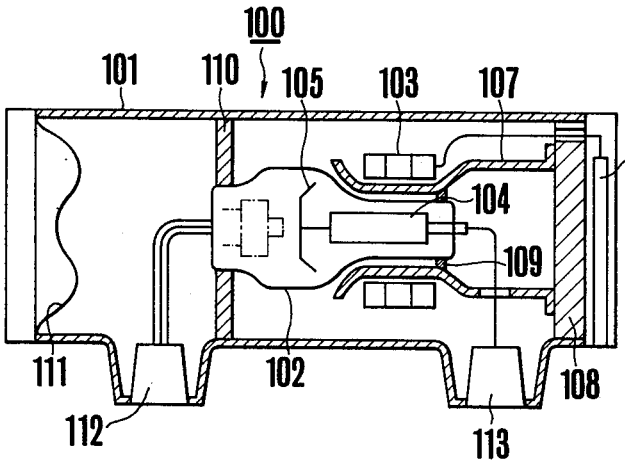
FIG. 1A PRIOR ART
FIG. 1A is a longitudinal sectional view of an X-ray tube unit utilizing a prior art rotary anode type X-ray tube.
Figure 1B:
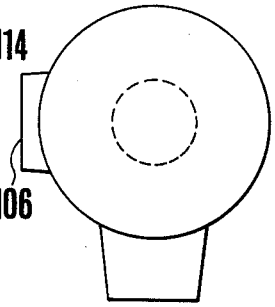
FIG. 1B PRIOR ART
FIG. 1B is an end view of the unit shown in FIG. 1A.

FIGS. 1A and 1B illustrate one example of the prior art X-ray tube unit. The X-ray tube unit generally designated by a reference numeral 100 comprises a housing 101, a rotary anode type X-ray tube 102 and a stator 103 contained in the housing. The X-ray tube comprises a rotor 104 surrounded by the stator 103 and a target 105 for generating X-rays. The target 105 is made of tungsten, for example, and rotated by the rotor 104. The target and the rotor constitute an anode electrode. The rotor 104 comprises a thin copper cylinder and supported by suitable bearings. The rotor is acted upon by the magnetic field created by the stator 103 to rotate by the principle of an induction motor. The periphery of the target 105 is inclined and the electron beam is focussed to a point X or a small area around the point X (See FIG. 1B.) on the inclined portion, so that the X-rays generated at this point is taken out to the outside through a window 106. The cathode with filaments is shown by dotted lines in FIG. 1A. As will be described latter, since the potential difference between the anode electrode and the stator 103 is considerably high, a cylindrical insulator 107 made of plastics or glass is disposed therebetween. One end of the insulator 107 is secured to a support 108 by screws or the like and a supporting ring 109 is provided for an intermediate point of the insulator 107 for supporting one end of the X-ray tube 102. The other end of the X-ray tube is supported by a supporting plate 110 secured to the inside of the housing 101. The housing is constructed to be oil tight for containing insulating oil. Due to a large heat produced in the oil at the time of generating X-rays, the insulating oil expands but such expansion is relieved by a bellows 111 provided at one end of the housing 101. For this, the outer surface of the bellows is subjected to atmospheric pressure. The cathode and anode electrodes and the stator are connected to driving sources through cable receptacles 112, 113 and stator cord 114, respectively. Except the window 106 through which the X-rays are transmitted, the inner wall of the housing is covered with X-ray shielding material.

Figure 2:
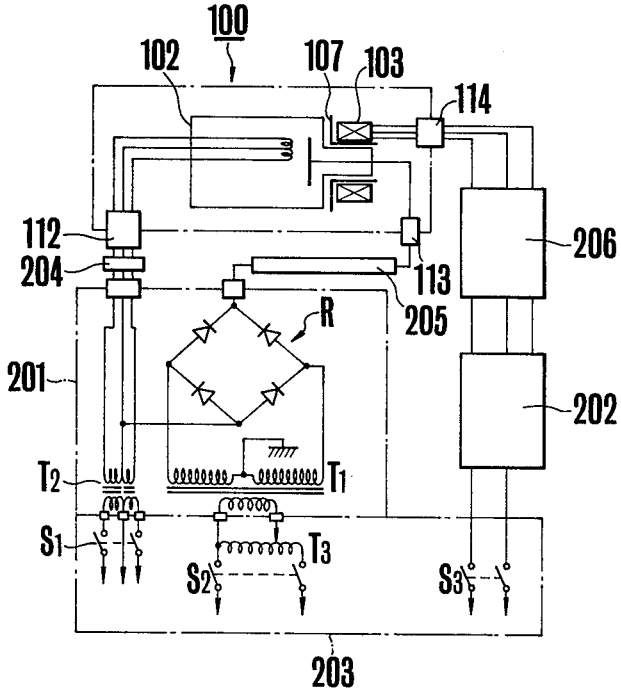
FIG. 2 PRIOR ART
FIG. 2 is a connection diagram of the X-ray apparatus using the X-ray tube unit shown in FIG. 1A.

FIG. 2 shows connections between the X-ray tube unit and driving source means, in which elements corresponding to those shown in FIG. 1 are designated by the same reference numerals. FIG. 2 shows one example of using a single phase AC source. The driving source means comprises a high voltage generating unit 201, a starter 202 and a control panel 203. The high voltage generating unit 201 comprises a transformer $T_1$ with its neutral point grounded, and a full wave rectifier circuit R for producing a high acceleration voltage of 150 KV for example, of which +75KV is impressed upon the anode electrode while −75KV is upon the cathode electrode through high voltage cables 205 and 204, respectively. A three-conductor type high voltage cable is usually used so that two conductors are used to energize the filament of the cathode electrode from filament transformer $T_2$. The stator 103 is energized from a source of small potential difference at low level through a starter 202 and a low voltage cable 206. When source switches $S_1$, $S_2$ and $S_3$ of the control panel 203 are closed, the X-ray tube unit 100 is started. The control panel 203 contains a voltage adjusting transformer $T_3$ or a voltage regulator for varying the acceleration voltage.

With this construction, as a positive high potential is impressed upon the anode electrode and a small potential difference at low level is impressed across the stator, the potential difference between the anode and stator is large.

One embodiment of this invention will now be described with reference to FIGS. 3 and 4. In this embodiment, similar to the circuit shown in FIG. 2, negative high potential generated by a high voltage generating circuit comprising transformer $T_1$, voltage regulator $T_3$ and full wave rectifier circuit R, and small AC potential difference generated by filament transformer $T_2$ are supplied to the X-ray tube unit through a high voltage cable 204. According to this invention, however, a high voltage insulation transformer 401 is provided for the high voltage generating unit 400 and one of the output terminals of the high voltage insulation transformer 401 is connected to the positive terminal P of the rectifier R. Thus, the small AC potential difference and the positive high potential are applied to the stator and the positive high potential is applied to the anode electrode of the X-ray tube through a high voltage cable 402.

Figure 7:
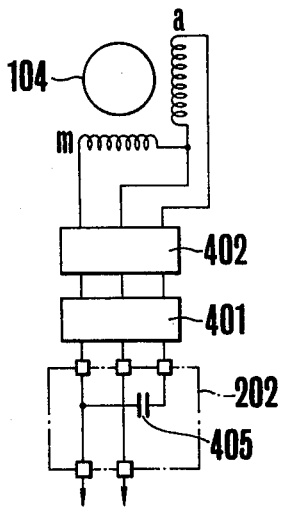
FIG. 7 is a connection diagram of a driving circuit for a single phase motor.
Figure 8:
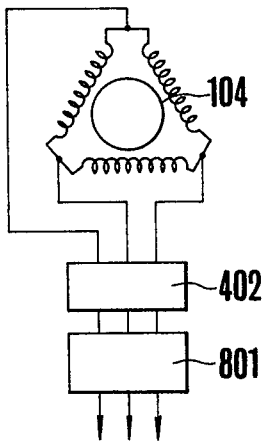
FIG. 8 is a connection diagram for a three phase motor.

The stator winding which rotates rotor 104 by the principle of an induction motor is energized as follows. FIG. 7 shows a driving circuit for the stator utilizing a single phase AC source, whereas FIG. 8 shows a three phase driving circuit. In the case shown in FIG. 7, the stator winding comprises a main winding *m* and an auxiliary winding *a*, and one terminal of the main winding, the common juncture between the main and auxiliary windings, and one terminal of the auxiliary winding are connected to a starter 202 via high voltage cable 402 and a high voltage insulation tranformer 401 connected as shown in FIG. 4. A capacitor 405 is provided for the starter for producing a phase difference between the potential difference applied across the main winding *m* and the potential difference applied across the auxiliary winding *a* necessary to provide a single phase induction motor operation.

In FIG. 8 the stator windings are connected in a three phase delta, and three terminals of the stator windings are connected to a three phase high-voltage insulation transformer 801 through a high voltage cable 402. The transformer 801 may comprise three single phase high-voltage insulation transformers connected to form a three phase high-voltage insulation transformer or a single transformer of three phase high-voltage connection.

Referring again to FIG. 4, high voltage cable 402 connected to the positive high potential output terminal P usually comprises three conductors so that one of the conductors is connected to the anode electrode and to one terminal of the stator windings while the other two conductors are connected to the main and auxiliary windings, respectively. Consequently, the anode electrode and the stator windings are maintained at substantially the same potential so that it is not necessary to provide an insulation between the anode electrode and the stator.

Figure 3:
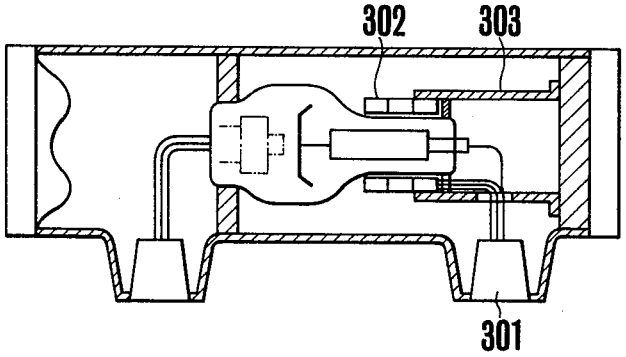
FIG. 3 is a longitudinal sectional view of an X-ray unit utilizing a novel X-ray tube of this invention.
Figure 4:
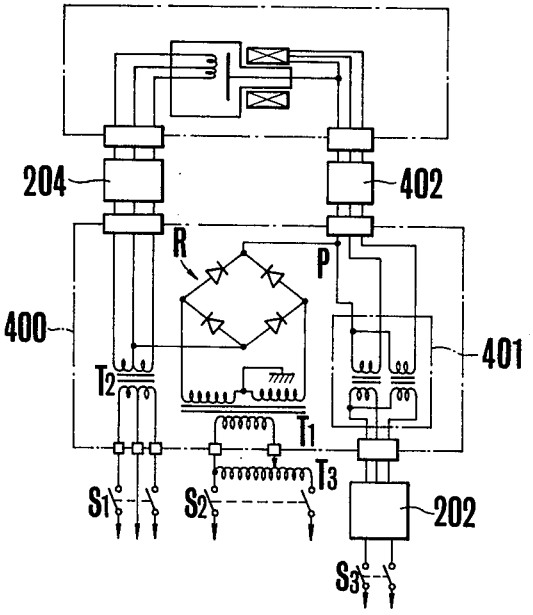
FIG. 4 is a connection diagram of the X-ray apparatus using the X-ray tube unit shown in FIG. 3.

The anode potential and the stator driving potential difference are supplied through a common cable receptacle 301 as shown in FIG. 3. It is possible to reduce the gap between the X-ray tube 102 (See FIG. 1) and the stator 103 to substantially zero. In the prior art construction, it is noted that the gap is about 8mm but it increases rapidly as the acceleration voltage increases.

Accordingly, it is possible to eliminate the insulating cylinder 107, and the stator 302 can be supported by supporting cylinder 303.

Figure 5:
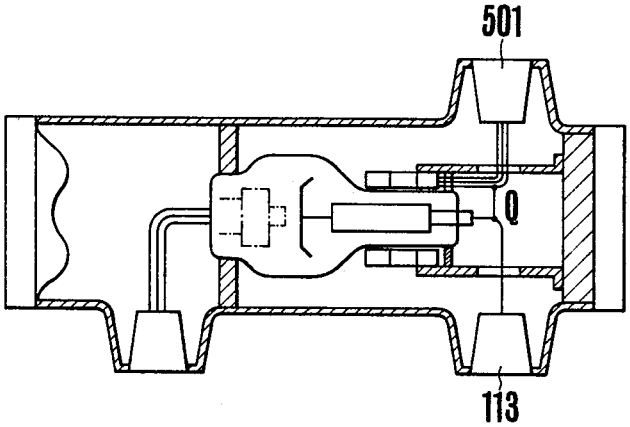
FIG. 5 is a longitudinal sectional view showing a modification of the invention.
Figure 6:
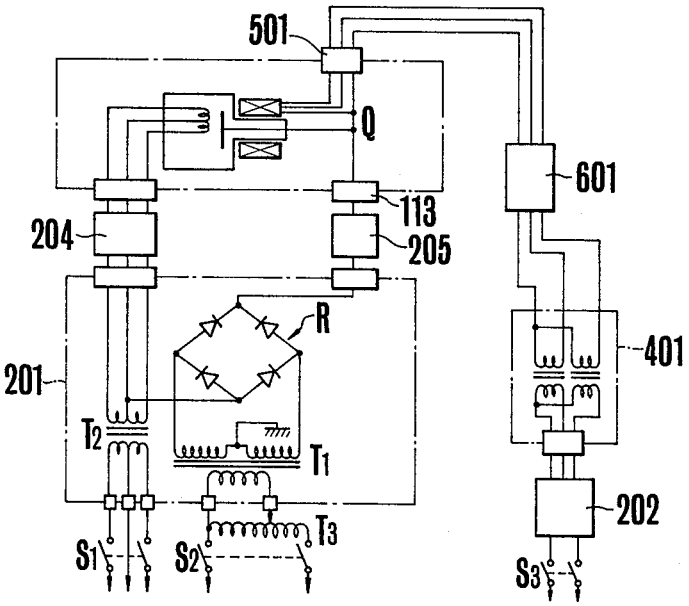
FIG. 6 is a connection diagram of the X-ray apparatus using the X-ray tube unit shown in FIG. 5.

FIGS. 5 and 6 show another embodiment of this invention. In the previous embodiment, a high voltage insulation transformer 401 was incorporated into high voltage generating unit 400 and one terminal of the stator driving source was connected to the positive output terminal P in the high voltage generating unit 400, but in this modification, the stator driving source is separated from the high voltage generating unit 201. Thus, a cable receptacle 501 is provided to connect the stator driving source including starter 202 to the stator, and one terminal of the stator is connected to the positive high potential terminal at a point Q within the X-ray unit. Accordingly, cable 601 for connecting the stator to the stator driving source must be a high voltage cable. It will be clear that this modification has the same advantages as the first embodiment. Depending upon the condition of use of the X-ray apparatus, the high voltage insulation transformer 401 may be incorporated into the high voltage generating unit 400 as shown in FIG. 4 or may be constructed independently as shown in FIG. 6.

Further, it will also be clear that one of the terminals of the stator driving source may be connected to the positive output terminal in the high voltage insulation transformer 401.

In the X-ray apparatus embodying the invention, a high potential is impressed upon the stator so that a high potential difference occurs between the stator and the housing of the X-ray tube unit which is generally at the ground potential. However, as the space between the X-ray tube and the housing is filled with insulating oil it is not necessary to provide any additional insulation.

As above described, the principal object of this invention is to improve the insulation of the anode structure of an X-ray tube. Since it is not necessary to provide any insulation between the stator and the anode structure, it is possible to extremely reduce the gap between the stator and the rotor even when the acceleration voltage is increased thereby not only increasing the efficiency of the motor but also decreasing the size of the X-ray tube unit.

What is claimed is:

1. In an X-ray apparatus comprising an X-ray tube unit and driving source means therefor, wherein said X-ray tube unit includes a rotary anode type X-ray tube with an anode electrode having a target adapted to generate X-rays and a rotor for rotating said anode electrode, said anode electrode being rotatably supported in an envelope, and with a cathode electrode having at least one filament which is disposed in said envelope to oppose said target, and includes a stator positioned on the outside of said envelope and provided with stator windings for generating a magnetic field for rotating said rotor; and said driving source means includes means for impressing a voltage across said filament, means for impressing a predetermined negative high potential upon said cathode electrode, means for impressing a predetermined positive high potential upon said anode electrode, and means for impressing a low motive power potential difference at high potential across the terminals of said stator windings, the improvement wherein said means for impressing the low potential difference at high potential across the terminals of said stator windings includes a high voltage insulation transformer having a primary winding and a secondary winding which are insulated from each other, said primary winding is connected to a source of alternating current, said secondary winding is connected to energize said stator windings with motive power for driving said rotor, and one of the stator windings is connected to receive said positive high potential such that said anode and said stator windings are at the same high positive potential.

2. The X-ray apparatus according to claim 1 wherein said means for impressing the potential difference across the filament, said means for impressing the negative high potential, said means for impressing the positive high potential, and said insulation transformer are fabricated as a unit, a terminal producing said positive high potential is connected to either side of said secondary winding within said unit, and said positive high potential and the potential difference of said secondary winding of the insulation transformer are applied to said anode electrode and said stator windings through the same high voltage cable.

3. The X-ray apparatus according to claim 1 wherein said means for impressing the potential difference across said filament electrode, said means for impressing said negative high potential and said means for impressing said positive high potential are fabricated as a unit independent of said insulation transformer, said positive high potential is applied to said anode electrode through a first high voltage cable, the secondary winding of said insulation transformer is connected to said stator windings through a second high voltage cable, and said first high voltage cable is connected to either one of the terminals of said stator windings within said X-ray tube unit.

4. The X-ray apparatus according to claim 1 wherein said stator windings are connected as a single phase insulation transformer.

5. The X-ray apparatus according to claim 1 wherein said stator windings are connected as a polyphase winding and energized by a three phase insulation transformer.

* * * * *